US006904958B2

(12) United States Patent
Ozaki et al.

(10) Patent No.: US 6,904,958 B2
(45) Date of Patent: Jun. 14, 2005

(54) HEAT EXCHANGER

(75) Inventors: Tatsuo Ozaki, Okazaki (JP); Norihisa Sasano, Ama-gun (JP); Takaaki Sakane, Nagoya (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 09/886,928

(22) Filed: Jun. 21, 2001

(65) Prior Publication Data

US 2001/0042611 A1 Nov. 22, 2001

Related U.S. Application Data

(63) Continuation of application No. PCT/JP00/07471, filed on Oct. 25, 2000.

(30) Foreign Application Priority Data

Oct. 25, 1999 (JP) ..... 11-302705

(51) Int. Cl.[7] ..... F18F 9/00

(52) U.S. Cl. ..... 165/67; 165/173; 165/175; 165/185; 165/80.3; 180/68.4

(58) Field of Search ..... 165/185, 80.3, 165/67, 173, 175; 180/68.4

(56) References Cited

U.S. PATENT DOCUMENTS

| | | | | | |
|---|---|---|---|---|---|
| 3,368,617 | A | * | 2/1968 | Malek et al. | 165/175 |
| 3,866,675 | A | * | 2/1975 | Bardon et al. | 165/173 |
| 5,236,042 | A | * | 8/1993 | Kado | 165/149 |
| 5,257,662 | A | * | 11/1993 | Osborn | 165/173 |
| 5,259,449 | A | * | 11/1993 | Case | 165/173 |
| 5,299,635 | A | * | 4/1994 | Abraham | 165/173 |
| 5,325,914 | A | * | 7/1994 | Tanaka | 165/67 |
| 5,482,114 | A | * | 1/1996 | Lu | 165/149 |
| 5,522,457 | A | | 6/1996 | Lenz | |
| 5,630,326 | A | * | 5/1997 | Nishishita et al. | 62/299 |
| 5,875,836 | A | * | 3/1999 | Nakamura | 165/122 |
| 5,904,206 | A | * | 5/1999 | Kroetsch | 165/173 |
| 6,035,931 | A | * | 3/2000 | Kado et al. | 165/174 |
| 6,073,688 | A | * | 6/2000 | Kato | 165/177 |
| 6,167,946 | B1 | * | 1/2001 | Uchikawa et al. | 165/71 |
| 6,167,953 | B1 | * | 1/2001 | Kobayashi et al. | 165/173 |

(Continued)

FOREIGN PATENT DOCUMENTS

| | | | | |
|---|---|---|---|---|
| DE | 4421835 | | 1/1996 | |
| JP | 404353397 | * | 12/1992 | F28F/9/02 |
| JP | 08327286 A | * | 12/1996 | F28F/9/00 |
| JP | 11-287584 | * | 10/1999 | F28F/9/00 |

OTHER PUBLICATIONS

German Office Action dated Aug. 19, 2002, German Application No. 100 83 636.4–16 with translation.
Patent Abstracts of Japan for Publication No. 2000283689, dated Oct. 13, 2002.
Patent Abstracts of Japan for Publication No. 10122785, dated May 15, 1998.

*Primary Examiner*—Henry Bennett
*Assistant Examiner*—Nihir Patel
(74) *Attorney, Agent, or Firm*—Harness, Dickey & Pierce, PLC

(57) ABSTRACT

A tapered section and a flange section which constitute reinforcements are provided on mounting members to which a blower (fan shroud) is to be attached. The reinforcements are provided on the sides of the reinforcements which are in contact with a longer side wall surface of a rectangular tank. According to this structure, it is possible to prevent the longer side wall surface from deforming, while mitigating the concentration of stress to the joint portions between the mounting members and the longer side wall surface. Therefore, the mechanical strength, reliability and durability of the header tank can be improved without increasing the mass (weight) and production cost of the radiator.

14 Claims, 9 Drawing Sheets

U.S. PATENT DOCUMENTS 6,173,765 B1 * 1/2001 Uchikawa et al. ..... 165/173
6,230,793 B1 * 5/2001 Sumida ..... 165/140
6,234,238 B1 * 5/2001 Koyama et al. ..... 165/78
6,250,381 B1 * 6/2001 Nishishita ..... 165/175
6,267,174 B1 * 7/2001 Ozaki et al. ..... 165/140
6,273,182 B1 * 8/2001 Pautler et al. ..... 165/67
6,273,184 B1 * 8/2001 Nishishita ..... 165/140
6,283,200 B1 * 9/2001 Sugimoto et al. ..... 165/173
6,305,465 B1 * 10/2001 Uchikawa et al. ..... 165/140
6,357,521 B1 * 3/2002 Sugimoto et al. ..... 165/173
6,408,939 B1 * 6/2002 Sugimoto et al. ..... 165/140
6,513,585 B2 * 2/2003 Brost et al. ..... 165/175
6,675,883 B1 * 1/2004 De Keuster et al. ..... 165/173
6,786,275 B2 * 9/2004 Dey et al. ..... 165/173

* cited by examiner

HEAT EXCHANGER

CROSS-REFERENCE TO RELATED APPLICATIONS

This application is based upon and claims priority of Japanese Patent Application No. 11-302705, filed Oct. 25, 1999, the contents being incorporated therein by reference, and a continuation of PCT Application No. PCT/JP00/07471, filed Oct. 25, 2000.

TECHNICAL FIELD

The present invention relates to a heat exchanger having a mounting member for attaching a blower thereto and suitable for a car radiator.

BACKGROUND ART

A blower for supplying cooling air to a radiator is generally attached to the radiator via a fan shroud. Therefore, in the prior art, pin-like projections are formed integrally with a radiator tank made of resin, for mounting the blower (fan shroud) thereto.

In this regard, as is well-known, the fan shroud covers the blower to support the same and prevent the supplied air from bypassing the radiator.

Recently, to reduce industrial waste by improving the recycling ability of car parts including the radiator, car parts improved in recycling ability have been eagerly desired.

To satisfy this demand, in the case of conventional radiators (heat exchangers), it is necessary to classify materials thereof into metal and resin because each of them is generally composed of two kinds or more of materials, including at least metal and resin. Accordingly, man-hours for recycling (man-hours necessary for classifying materials) becomes large thereby causing a problem in that the recycling ability is lowered.

To solve this problem, the present inventors attempted to form a heat exchanger from metallic (aluminum) components, and found that a sufficient mechanical strength is not obtainable in a header tank resulting in a problem in that the header tank deforms due to inner pressure.

Although this problem might be solved by increasing a plate thickness of members constituting the header tank, such a countermeasure would increase the mass (weight) and production cost of the heat exchanger.

Also, if the mounting member for attaching the blower (fan shroud) is secured to the header tank as in the above-mentioned conventional structure, stress is concentrated on a joint portion between the mounting member and the header tank when the blower vibrates, for example, due to the oscillation of a car, resulting in a risk of breakage of the header tank.

DISCLOSURE OF INVENTION

An object of the present invention is to improve the mechanical strength of a header tank while suppressing the increase of mass (weight) and production cost of a heat exchanger.

In this regard, when inner pressure is applied to a header tank (120) having a rectangular cross-section, the header tank (120) deforms so that a longer side wall surface (120*c*) having a larger pressure-receiving area is swollen.

Accordingly, to achieve the above object in view of such a point, in one embodiment of the present invention, a heat exchanger comprises a plurality of metallic tubes (111) through which fluid flows, and a pair of metallic header tanks (120) of a rectangular cross-section communicating with the plurality of tubes (111); the header tanks being arranged at lengthwise opposite ends of the tubes (111) and extending perpendicular to the lengthwise direction of the tubes (111); wherein the mounting members (128, 129) to which the blower is to be attached are secured to a longer side wall surface (120*c*) of the header tank (120), and reinforcements (128*a*, 129*a*) are provided in the mounting members (128, 129) on the sides to be in contact with the longer side wall surface (120*c*), for strengthening the longer side wall surface (120*c*).

According to this arrangement, it is possible to mitigate the concentration of stress generated in the joint portions between the mounting member (128, 129) and the longer side wall surface (120*c*) caused by the car oscillation and prevent the longer side wall surface (120*c*) from being largely deformed.

Thus, according to the present invention, by providing the reinforcement in the longer side wall surface (120*c*) having a larger pressure-receiving area, it is possible to improve the mechanical strength of the header tank (120) (particularly, the longer side wall surface (120*c*)) without the increase in mass (weight) and production cost of the heat exchanger caused by excessive reinforcement, whereby the reliability and the durability of the heat exchanger can be improved.

According to another embodiment of the present invention, a heat exchanger comprises a plurality of metallic tubes (111) through which fluid flows, and a pair of metallic header tanks (120) of a rectangular cross-section communicating with the plurality of tubes (111); the header tanks being arranged at lengthwise opposite ends of the tubes (111) and extending perpendicular to the lengthwise direction of the tubes (111); wherein concave and convex portions (120*e*) are formed in a portion of a longer side wall surface (120*c*) of the header tank (120) by the plastic deformation thereof, and mounting members (128, 129) to which a blower is to be attached are secured to other portions of the longer side wall surface (120*c*) having no concave and convex portions (120*e*), and wherein reinforcements (128*a*, 129*a*) are provided in the mounting members (128, 129) on the sides to be in contact with the longer side wall surface (120*c*), for strengthening the longer side wall surface (120*c*).

According to this arrangement, it is possible to mitigate the concentration of stress generated in the joint portions between the mounting member (128, 129) and the longer side wall surface (120*c*) caused by the car oscillation and further effectively prevent the longer side wall surface (120*c*) from being largely deformed.

Thereby, also in this embodiment, it is possible to improve the mechanical strength of the header tank (120) (particularly, the longer side wall surface (120*c*)) without the increase in mass (weight) and production cost of the heat exchanger, whereby the reliability and the durability of the heat exchanger can be improved.

The present invention will be better understood with reference to the following description of the preferred embodiments of the present invention and the attached drawings.

BEST MODES FOR CARRYING OUT THE INVENTION (First Embodiment)

Figure 1:
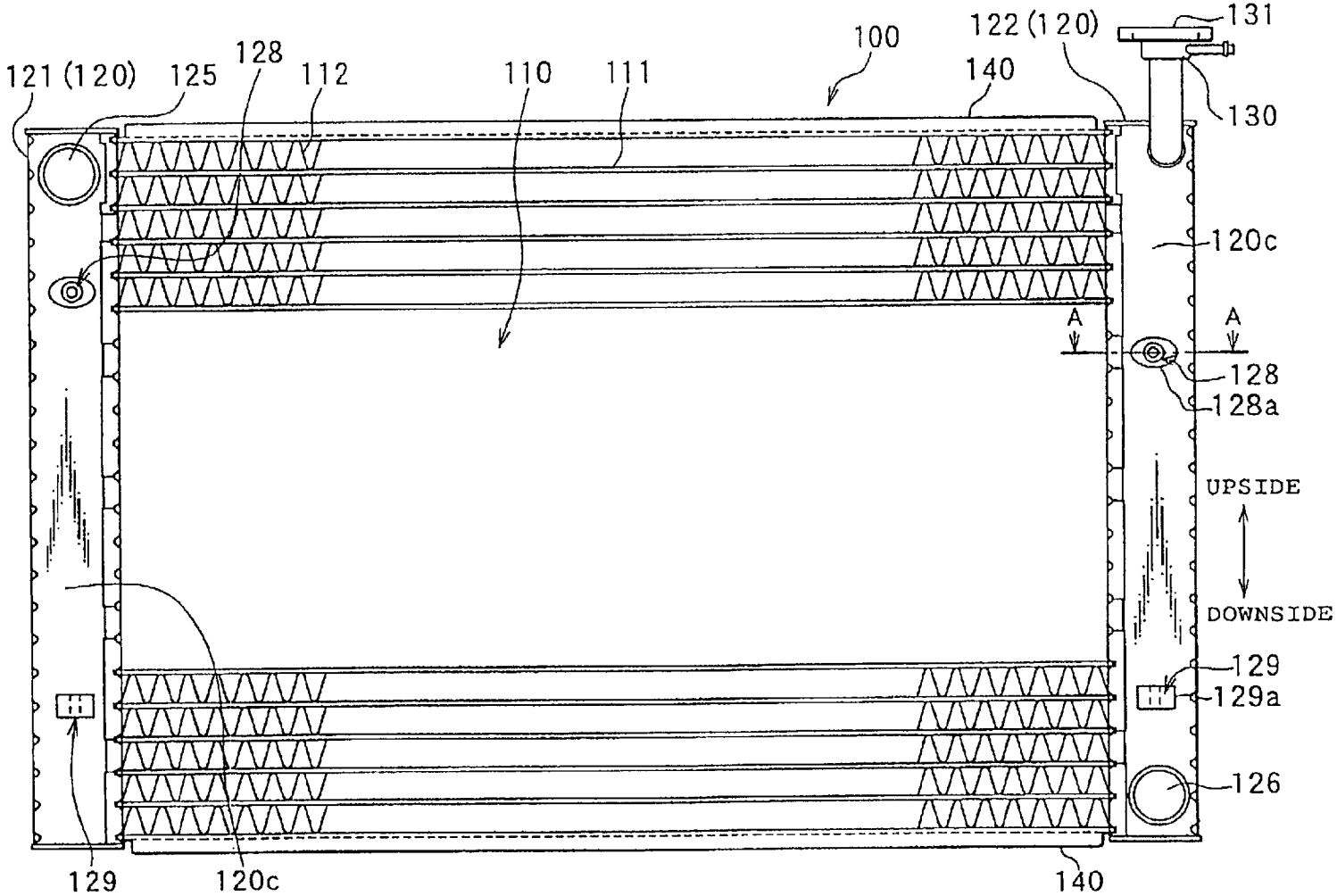
FIG. 1 is a front view of a radiator according to a first embodiment of the present invention.

In this embodiment, a heat exchanger according to the present invention is applied to a car radiator, and FIG. 1 is a front view of the heat exchanger (radiator) 100 as seen from a downstream side of air flow.

Reference numeral 111 denotes a plurality of tubes in a flat shape for circulating coolant water, which are formed by the extrusion or drawing of aluminum stocks. Reference numeral 112 denotes a fin, made of aluminum, disposed between the adjacent tubes 111 for facilitating the heat exchange between air and coolant water, which is formed in a wave shape (a corrugated shape) by roller shaping. A radiator core 110 for cooling the coolant water by the heat exchange between the coolant water and the air is constituted by the fins 112 and the tubes 111.

First and second header tanks 121, 122 made of aluminum are provided at lengthwise opposite ends of the tubes 111 and extend perpendicular to the lengthwise direction of the tubes 111 and communicate with a plurality of tubes 111, wherein the first header tank 121 located at one lengthwise end of the tubes 111 (a left end as seen in FIG. 1) operates to distribute the coolant water flowing out of an engine (not shown) to a plurality of tubes 111, while, the second header tank 122 located at the other lengthwise end of the tubes 111 (a right end as seen in FIG. 1) operates to collect the coolant water after the heat-exchange and direct the same to the engine. In this regard, the first and second header tanks 121, 122 will be hereinafter referred to as a header tank 120 as a whole.

Figure 2:
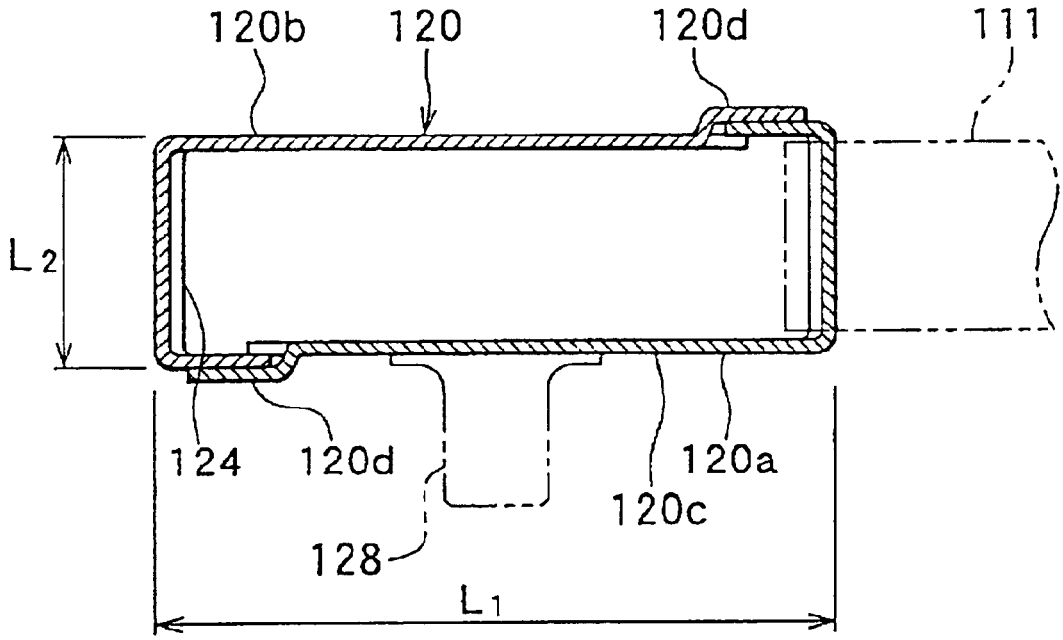
FIG. 2 is a sectional view taken along a line A—A in FIG. 1.

A cross-sectional shape of the header tank 120 is of a rectangular shape, as shown in FIG. 2, having a longer side in the direction parallel to the lengthwise direction of the tube 111 (that is, in the direction perpendicular to the direction of air flow). In this embodiment, this rectangular shape is flattened to have a longer side L1 of 40 mm or more and a shorter side L2 of 35 mm or less.

Figure 3A:
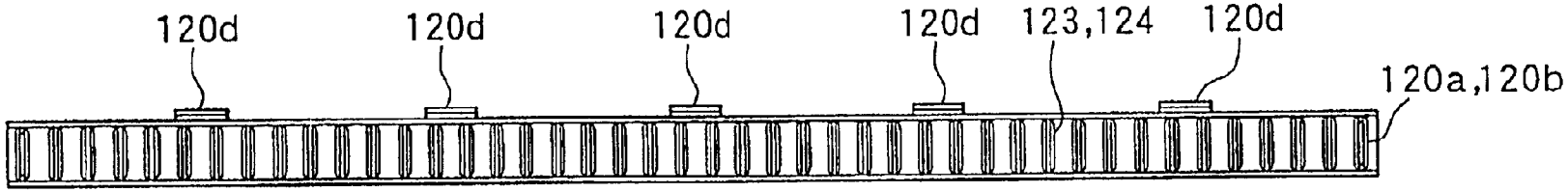
FIG. 3*a* is a front view of a first or second member in the first embodiment.
Figure 3B:
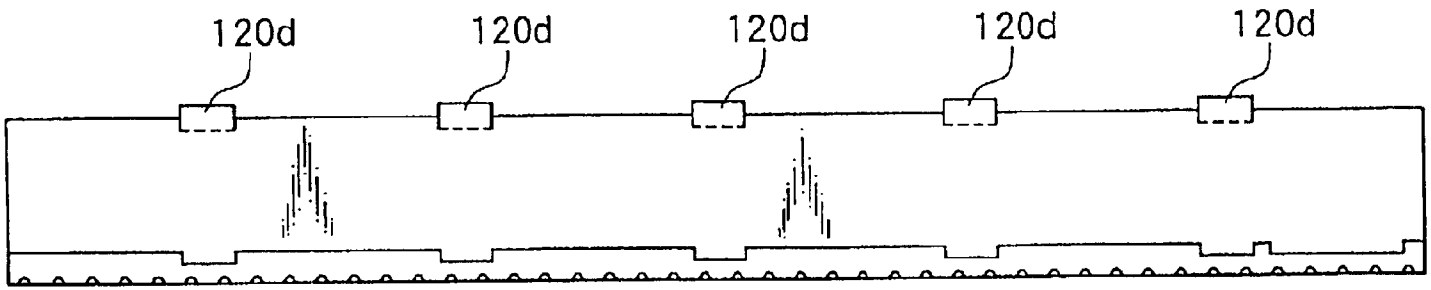
FIG. 3*b* is a bottom view of FIG. 3*a*.
Figure 3C:
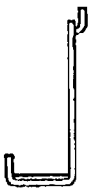
FIG. 3*c* is a side view of FIG. 3*b*.
Figure 4:
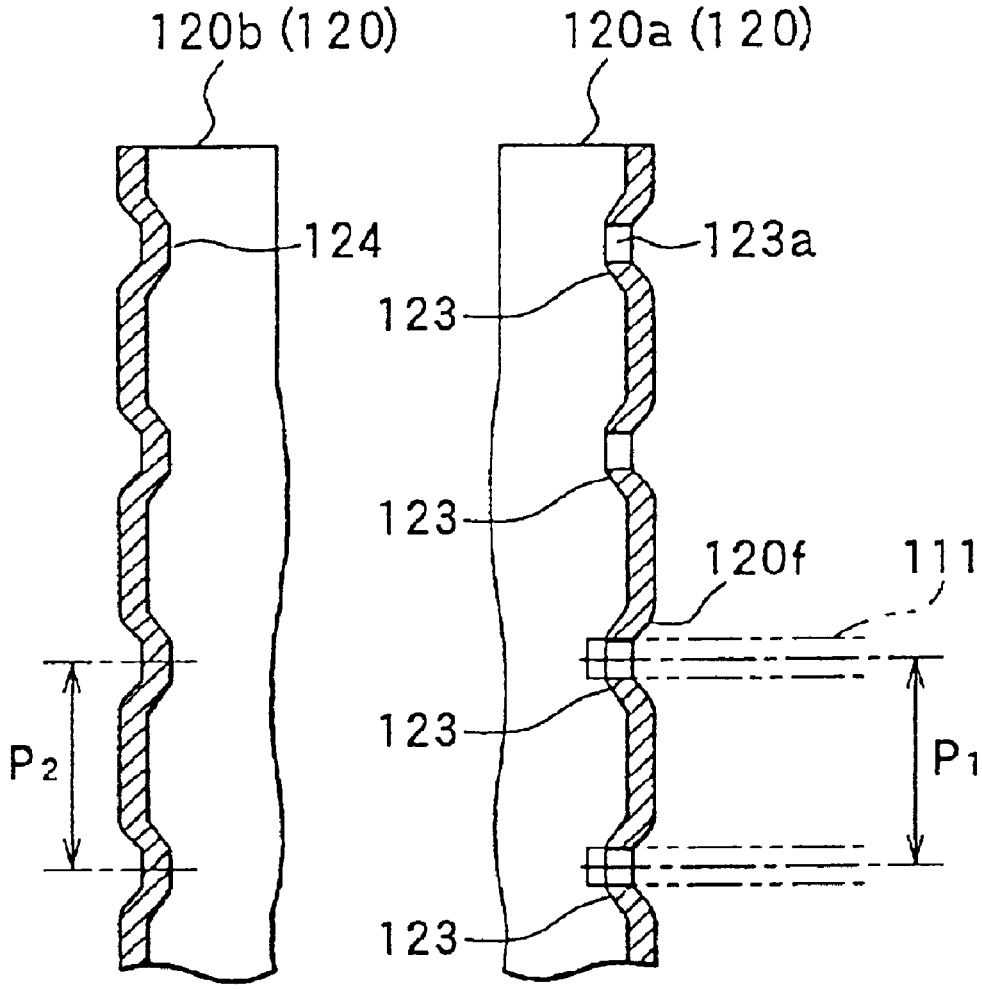
FIG. 4 is a sectional view of a header tank according to the first embodiment of the present invention.

As shown in FIGS. 3*a* to 3*c*, the header tank 120 is formed by fixing first and second members 120*a*, 120*b*, each shaped to have an L-shaped cross section by the press, with each other by the brazing, wherein, as shown in FIG. 4, first and second ribs 123, 124 are provided on the shorter side surface of the first and second members 120*a*, 120*b* by the plastic deformation of part of the first and second members 120*a*, 120*b* (the header tank 120) protruding toward the interior of the header tank 120 caused by burring (pressing).

A through-hole 123*a* is formed at a top of the respective first ribs 123 in the first member 120*a*, bored through the top wall in the thickness direction, and the tube 111 is inserted thereinto.

In this regard, since the sole difference between the first member 120*a* and the second member 120*b* is whether or not there is the through-hole 123*a*, the second ribs 124 are arranged on the opposite side from joint portions 120*f* of the header tank 120 with the tubes 111 at a pitch P2 approximately equal to that P1 of the tubes 111 in a state wherein both the members 120*a*, 120*b* and tubes 111 have been jointed together by brazing (that is, a state wherein the radiator 100 has been completed). As shown in FIGS. 2 and 3, each of the members 120*a*, 120*b* has grasping sections 120*d* for grasping the other member and rigidly brazing both the members 120*a*, 120*b* with each other.

Figure 6:
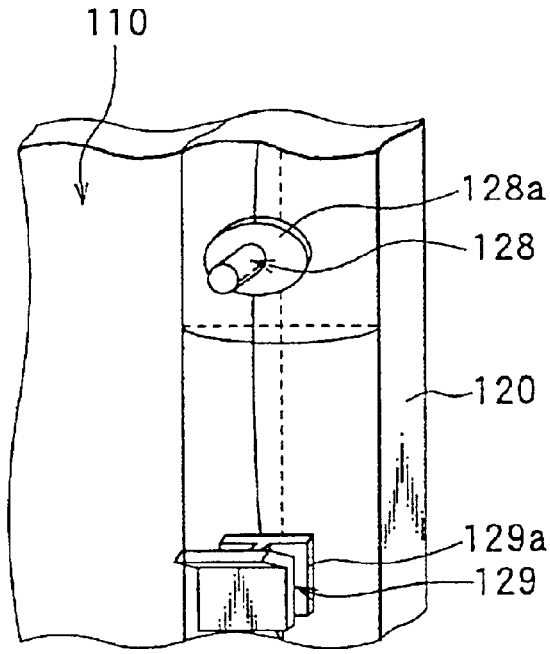
FIG. 6 is a perspective view of the header tank according to the first embodiment of the present invention.

In FIG. 1, reference numeral 125 denotes an entrance pipe to be connected to a coolant water exit of the engine, and reference numeral 126 denotes an exit pipe to be connected to a coolant water entrance of the engine. On a longer side wall surface 120*c* of the header tank 120, mounting members 128, 129 are provided for attaching a blower (fan shroud) as already described in BACKGROUND ART. As shown in FIG. 6, both of the mounting members 128, 129 are brazed on the midpoint M of the longer side wall surface 120*c* of the header tank 120 in the direction perpendicular to the lengthwise direction of the header tank 120 (i.e. on a line passing a middle point of the length L1 of the longer side).

Figure 5A:
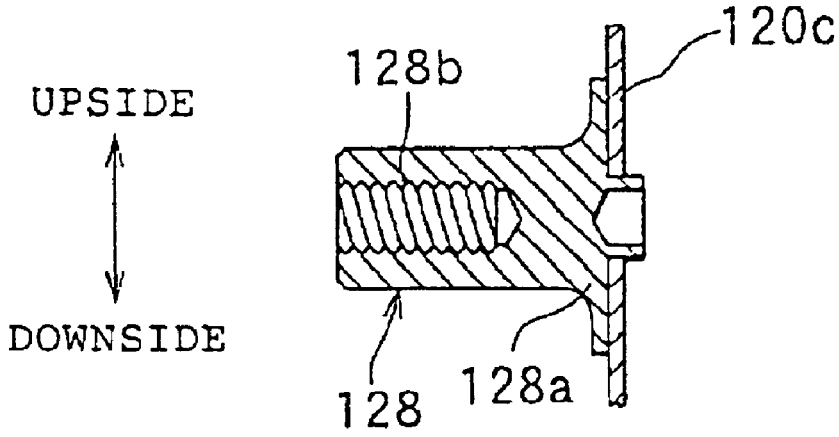
FIG. 5*a* is a sectional view of an upper mounting member.

In this regard, the upper mounting member 128 is a pin-like projection as shown in FIG. 5*a* and, in the wall surface 120*c* side of the mounting member 128, has a tapered section 128*a*, integrally formed of an aluminum stock, whose cross-sectional area increases as approaching the wall surface 120*c*. The tapered section 128*a* has an oval (elliptic) cross-sectional shape, as shown in FIG. 6, extending in the lateral direction (the longer side direction) perpendicular to the lengthwise direction (the upper/lower direction) of the header tank 120.

Accordingly, the tapered section 128*a* extends in the direction perpendicular to the lengthwise direction (in the longer side direction) of the header tank 120 to cross the median (center line) of the wall surface 120*c*, as a result, such a structure functions as a reinforcement for strengthening the longer side wall surface 120*c*. In addition, a female-threaded hole 128*b* to be engaged with a bolt is formed in a tip portion of the mounting member 128.

Figure 5B:
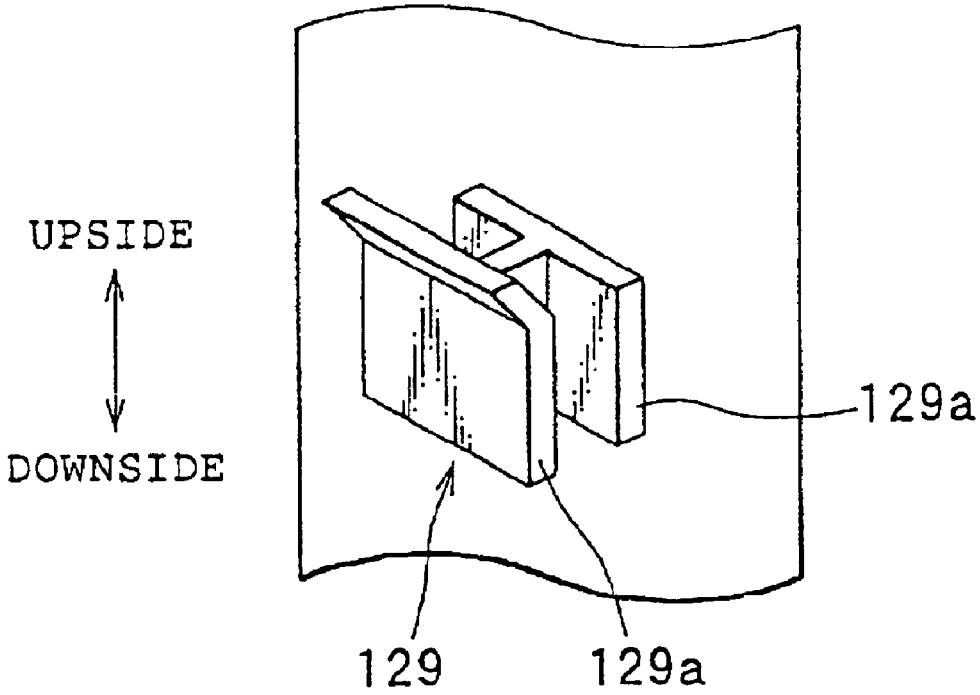
FIG. 5*b* is a perspective view of a lower mounting member.

On the other hand, the lower mounting member 129 is formed of an aluminum stock by the extrusion or the drawing so that rectangular flange sections 129*a* are integrally provided on the distal and proximal ends thereof as shown in FIG. 5*b*, wherein the proximal flange section 129*a* located in the wall surface 120*c* side functions as a reinforcement for strengthening the longer side wall surface 120*c*.

In this connection, the fan shroud (blower) is assembled to the radiator 100 (header tank 120) in the manner that the lower portion of the fan shroud (not shown) is secured to the mounting member 129 by the insertion engagement thereof with a U-shaped groove of a hook (stay) provided on the lower portion of the fan shroud, while the upper portion thereof is fixed to the mounting member 128 by the bolt.

In FIG. 1, reference numeral 130 denotes a water inlet (filler neck) for replenishing coolant water, and reference numeral 131 denotes a radiator cap of a well-known pressurized type for closing the water inlet 130. Reference numeral 140 denotes a side plate extending parallel to the lengthwise direction of the tube 111 at each of opposite ends of the radiator core 110 to form a reinforcement of the latter.

Characteristics of this embodiment will be described below.

Figure 7:
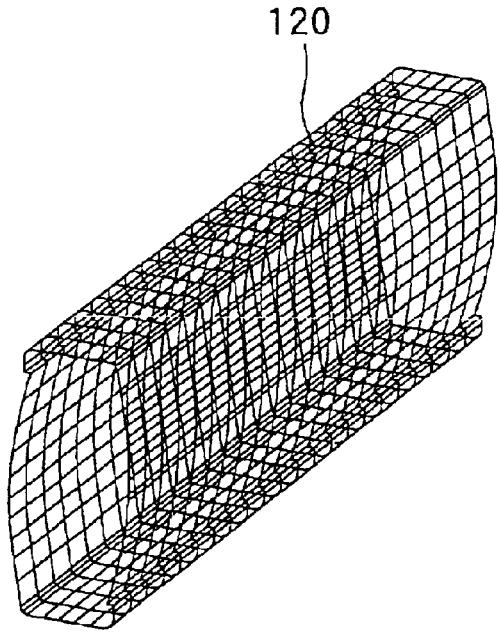
FIG. 7 is a wire diagram showing the deformation of the header tank.

When the inner pressure is applied to the header tank 120 having a rectangular cross section, the header tank 120 is deformed to swell the longer side wall surface 120*c* having a larger pressure-receiving area, as shown in FIG. 7.

Contrarily, according to this embodiment, since the tapered section 128*a* and the flange section 129*a* are provided as the reinforcement for the mounting members 128, 129, respectively, on the sides to be in contact with the longer side wall surface 120*c*, it is possible to prevent the longer side wall surface 120*c* from being largely deformed, while mitigating the concentration of stress generated in the joint portions between the mounting member 128, 129 and the longer side wall surface 120*c* caused by the car oscillation.

Thus, according to this embodiment, by providing the reinforcement in the longer side wall surface 120*c* having a larger pressure-receiving area, it is possible to improve the mechanical strength of the header tank 120 (particularly, the longer side wall surface 120*c*) without the increase in mass (weight) and production cost of the radiator 100 caused by excessive reinforcement, whereby the reliability and the durability of the radiator 100 can be improved.

Also, since the tapered section 128*a* of the mounting member 128 constituting the reinforcement has a cross-sectional area which becomes larger approaching the wall surface 120*c*, the concentration of stress to the proximal end of the mounting member 128 can be assuredly mitigated.

In addition, since the tapered section 128*a* strengthens the longer side wall surface 120*c* by extending toward the opposite sides of the longer side direction of the header tank 120 while crossing the median (a center line) of the wall surface 120*c*, it is possible to further assuredly strengthen the longer side wall surface 120*c* having a larger pressure-receiving area.

Since the tapered section 128*a* and the flange section 129*a*, constituting the reinforcement, are formed integrally with the mounting members 128, 129, respectively, it is possible to reduce the production cost of the mounting members 128, 129 having the reinforcement.

(Second Embodiment)

Figure 8:
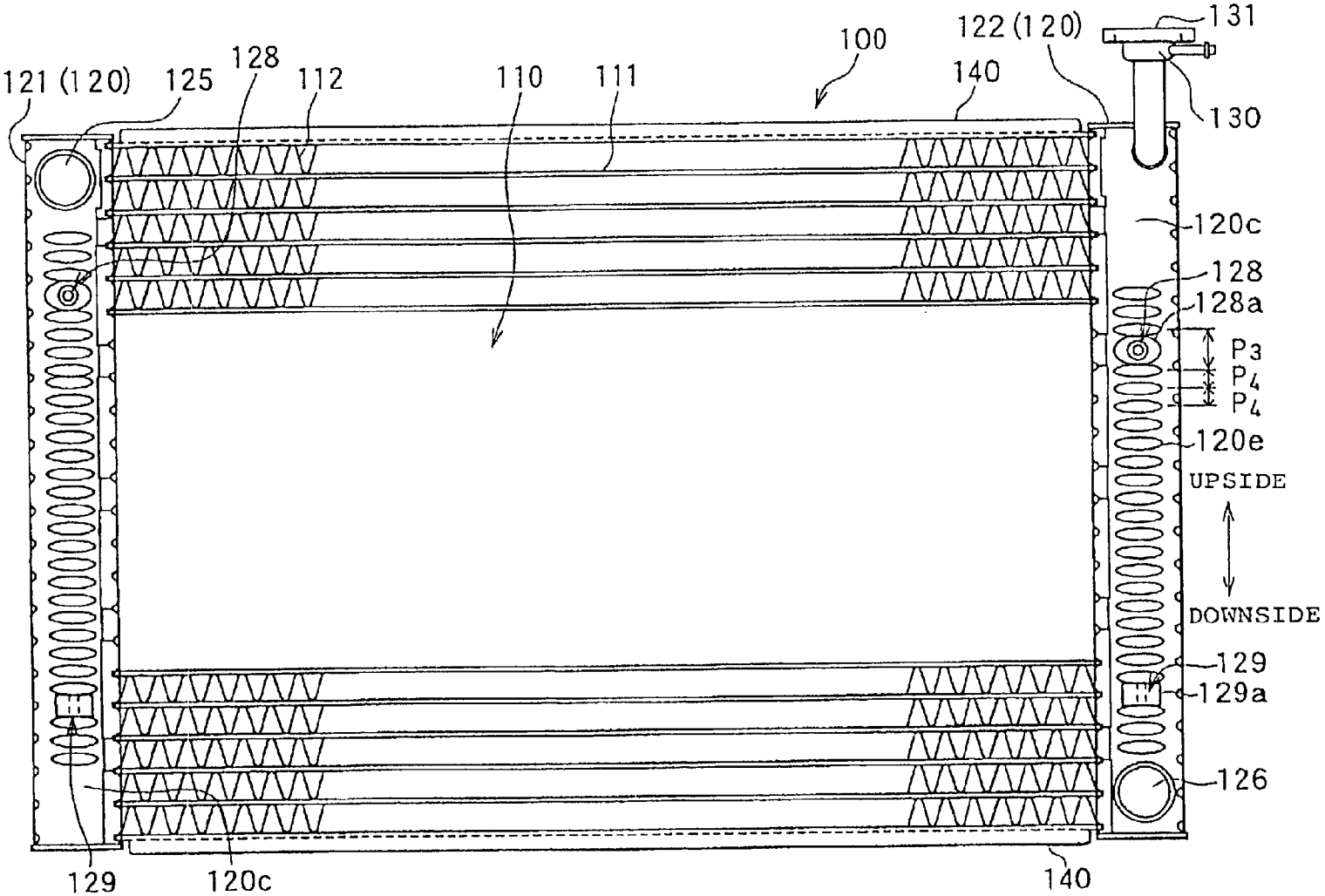
FIG. 8 is a front view of a radiator according to a second embodiment of the present invention.

While the reinforcement for strengthening the longer side wall surface 120*c* is provided solely by the tapered section 128*a* of the mounting member 128 and the flange section 129*a* of the mounting member 129 in the first embodiment, according to the present embodiment as shown in FIG. 8, a plurality of ribs (concave and convex portions) 120*e* arranged in the lengthwise direction of the header tank 120 are provided by plastically deforming portions of the longer side wall surface 120*c* during pressing (plastically deforming) the first and second members 120*a*, 120*b*, and the remaining part of the longer side wall surface 120*c* having no ribs 120*e* (an area in which a pitch P3 of the rib 120*e* is larger than that P4 in the other area in this embodiment) has the mounting member 128 or 129 attached thereto.

According to such an arrangement, the ribs 120*e* constitute the reinforcement for strengthening the longer side wall surface 120*c*, in addition to the tapered section 128*a* of the mounting member 128 and the flange section 129*a* of the mounting member 129, whereby the mechanical strength of the longer side wall surface 120*c* having a larger pressure-receiving area can be uniformly increased as a whole.

(Third Embodiment)

Figure 9:
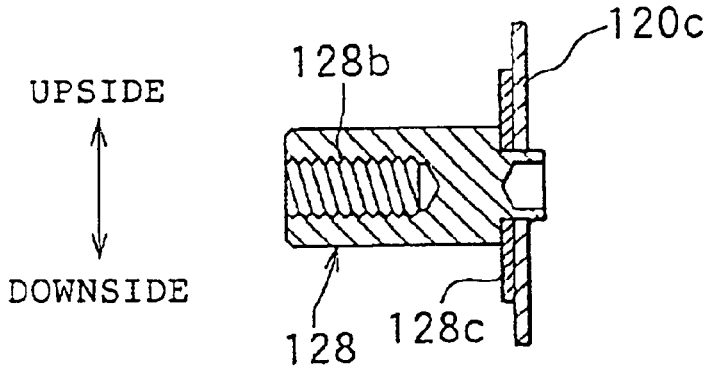
FIG. 9 is a sectional view of an upper mounting member according to a third embodiment of the present invention.

While the tapered section 128*a* of the mounting member 128 constituting the reinforcement is formed in integral with the mounting member 128 in the above-mentioned embodiments, a flange section 128*c* constituting a reinforcement is formed separately from a mounting member 128 and then brazed to the mounting member 128 for incorporating with the mounting member 128 in the present embodiment, as shown in FIG. 9.

In this regard, the flange section 128*c* is shaped to be an oval shape and secured to a longer side wall surface 120*c* so that a major axis of the oval shape thereof coincides with the longer side direction of the header tank 120.

Also, although the flange section 128*c* is not in a tapered shape in FIG. 9, the periphery wall portion of the flange section 128*c* may be tapered so that a cross-sectional area thereof increases as approaching the wall surface 120*c*.

(Fourth Embodiment)

Figure 10:
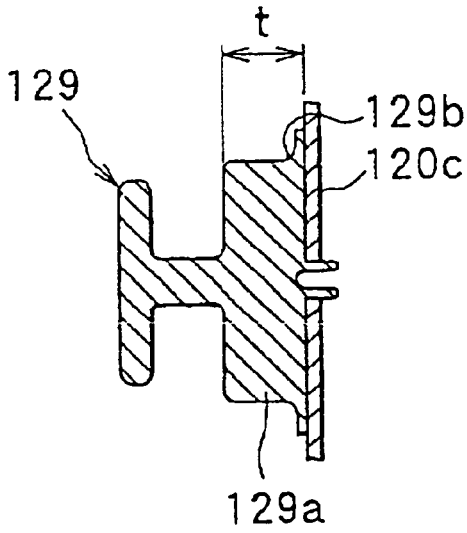
FIG. 10 is a sectional view of a lower mounting member according to a fourth embodiment of the present invention.

As shown in FIG. 10, according to the present embodiment, a wall thickness t of a flange section 129*a* of a mounting member 129 constituting the reinforcement becomes larger and a tapered section 129*b* is provided so that the cross-sectional area of the flange section 129*a* increases as approaching the wall surface 120*c*.

Thereby, it is possible to assuredly mitigate the concentration of stress to the proximal portion of the mounting member 129.

(Other Embodiments)

Figure 11A:
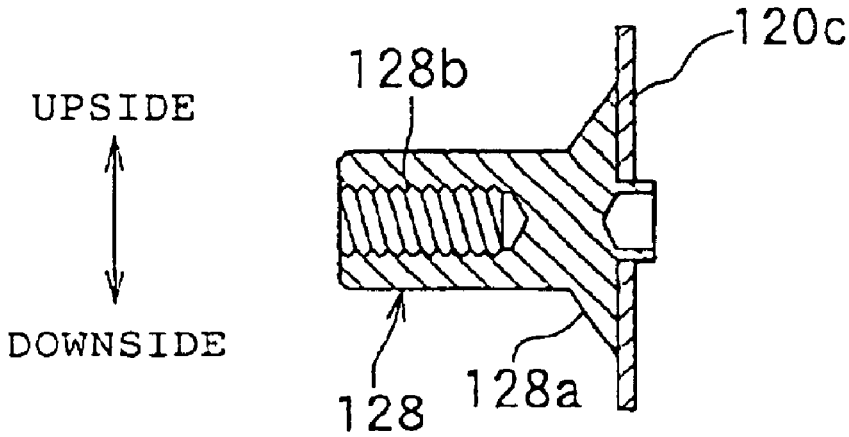
FIGS. 11*a* and 11*b* are sectional views, respectively, of mounting members according to modifications of the present invention.
Figure 11B:
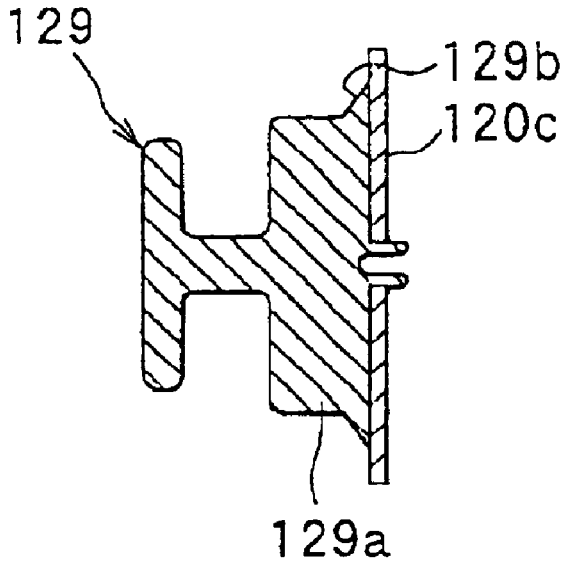

While the periphery wall portion of the tapered section 128*a* or 129*b* varies in an arcuate manner in each of the above-mentioned embodiments, in the present embodiments, the periphery wall portions of the tapered sections may linearly vary as shown in FIGS. 11*a* and 11*b*.

INDUSTRIAL APPLICABILITY

In the above embodiments, the radiator is a so-called cross-flow type wherein the length of the header tank 120 extends in the upper/lower direction and the length of the tube 111 extends in the horizontal direction. However, the present invention is similarly applicable to a so-called down-flow type radiator wherein the length of the header tank 120 extends in the horizontal direction and the length of the tube 111 extends in the upper/lower direction.

Although the present invention is applied to a radiator in the above embodiments, the present invention should not be limited thereto but also applicable to other types of heat exchangers such as a condenser or a duplex heat exchanger in which a condenser and a radiator are integral with each other.

The present invention has been described in detail above with reference to the specific embodiments. However, it will be understood that a person with ordinary skill in the art can make various changes and modifications based on the above description without departing from a scope and spirit of the present invention.

What is claimed is:

1. A heat exchanger having mounting members to which a blower is to be attached, comprising:

a plurality of metallic tubes through which fluid flows in a fluid flow direction;

a pair of metallic header tanks communicating with the plurality of tubes, each of the pair of header tanks being arranged at lengthwise opposite ends of the tubes and extending perpendicular to the lengthwise direction of the tubes, each of the pair of header tanks defining a rectangular cross section fluid chamber having a long side wall and a short side wall each of said header tanks being disposed such that said long side wall is generally parallel to said fluid flow direction and said short side wall is generally perpendicular to said fluid flow direction, concave and convex portions being formed in a first portion of the long side wall of the header tank by plastic deformation;

a respective mounting member secured on said long side wall of each of the header tanks; and a reinforcement attached to each of the mounting members on the side of the mounting member in contact with the long side wall, for strengthening the long side wall surface.

2. A heat exchanger as defined by claim 1, wherein each of the reinforcements extends from a middle point of the long side wall toward opposite sides of the long side wall.

3. A heat exchanger as defined by claim 1, wherein each of the reinforcements has a tapered section so that a cross-sectional area of the reinforcement increases as approaching the long side wall of the header tanks.

4. A heat exchanger as defined in claim 1, wherein each of the reinforcements and a respective mounting member are integrally formed.

5. A heat exchanger having mounting members to which a blower is to be attached, comprising:

a plurality of metallic tubes through which fluid flows in a fluid flow direction;

a pair of metallic header tanks communicating with the plurality of tubes, each of the pair of header tanks being arranged at lengthwise opposite ends of the tubes and extending perpendicular to the lengthwise direction of the tubes, each of the pair of header tanks defining a rectangular cross section fluid chamber having a long side wall and a short side wall, each of said header tanks being disposed such that said long side wall is generally parallel to said fluid flow direction and said short side wall is generally perpendicular to said fluid flow direction;

a respective mounting member secured on said long side wall of each of the header tanks; and a reinforcement attached to each of the mounting members on the side of the mounting member in contact with the long side wall for strengthening the long side wall, wherein the reinforcements and a respective mounting member are formed separately from each other.

6. A heat exchanger as defined by claim 1, wherein each of the reinforcement and a respective mounting member are formed separately from each other.

7. A heat exchanger as defined in claim 1, wherein the tubes are connected to each of the header tanks on the short side wall thereof.

8. A heat exchanger having mounting members to which a blower is to be attached, the heat exchanger comprising:

a plurality of metal tubes through which fluid flows;

a pair of metallic header tanks communicating with the plurality of tubes;

each of the pair of header tanks defining a fluid chamber and being arranged at lengthwise opposite ends of the tubes and extending perpendicular to the lengthwise direction of the tubes, each of the fluid chambers defined by the pair of header tanks having a rectangular cross section in a direction parallel to the lengthwise direction of the tubes;

a respective mounting member secured to a longer side wall of each of the header tanks, the mounting member being secured to a portion of the longer side wall forming the fluid chamber;

a reinforcement attached to each of the mounting members on the side of the mounting member in contact with the longer side wall for strengthening the longer side wall for strengthening the longer side wall; and concave and convex portions formed in a portion of the long side wall of the header tank by plastic deformation.

9. A heat exchanger having mounting members to which a blower is to be attached, the heat exchanger comprising:

a plurality of metal tubes through which fluid flows;

a pair of metallic header tanks communicating with the plurality of tubes, each of the pair of header tanks being arranged at lengthwise opposite ends of the tubes and extending perpendicular to the lengthwise direction of the tubes, each pair of header tanks defining a rectangular cross section fluid chamber in a direction parallel to the lengthwise direction of the tubes;

a respective mounting member secured to a longer side wall of each of the header tanks;

a reinforcement attached to each of the mounting member on the side of the mounting members in contact with the longer side wall, the reinforcement defining an increased wall thickness in a localized area to strengthen the longer side wall; and concave and convex portions formed in a portion of the long side wall of the header tank by plastic deformation.

10. A heat exchanger as defined by claim 1, wherein the respective mounting member is secured on a second portion of the long side wall, the second portion being different than the first portion.

11. A heat exchanger as defined by claim 1, wherein each of the header tanks comprises a pair of L-shaped plate members in which said concave and convex portions are formed by press forming.

12. The heat exchanger according to claim 8, wherein the concave and convex portions are formed between adjacent mounting members.

13. The heat exchanger according to claim 9, wherein the concave and convex portions are formed between adjacent mounting members.

14. A heat exchanger having mounting members to which a blower is to be attached, the heat exchanger comprising:

a plurality of metal tubes through which fluid flows;

a pair of metallic header tanks communicating with the plurality of tubes, each of the pair of header tanks being arranged at lengthwise opposite ends of the tubes and extending perpendicular to the lengthwise direction of the tubes, each pair of header tanks defining a rectangular cross section fluid chamber in a direction parallel to the lengthwise direction of the tubes;

a plurality of respective mounting members secured to a longer side wall of each of the header tanks;

a reinforcement attached to each of the mounting member on the side of the mounting members in contact with the longer side wall, the reinforcement defining an increased wall thickness in a localized area to strengthen the longer side wall; and concave and convex portions formed the long side wall of the header tank in between adjacent mounting members and adjacent reinforcements by plastic deformation.

* * * * *

UNITED STATES PATENT AND TRADEMARK OFFICE

CERTIFICATE OF CORRECTION

PATENT NO. : 6,904,958 B2
DATED : June 14, 2005
INVENTOR(S) : Ozaki et al.

It is certified that error appears in the above-identified patent and that said Letters Patent is hereby corrected as shown below:

Column 8,
Line 8, delete "for strengthening the longer side wall".
Line 63, after "formed" insert -- in --.

Signed and Sealed this

Eighth Day of November, 2005

JON W. DUDAS
*Director of the United States Patent and Trademark Office*